US005921767A

United States Patent [19]

Song

[11] Patent Number: 5,921,767

[45] Date of Patent: Jul. 13, 1999

[54] MUSIC PRODUCING CANDLE

[75] Inventor: Jin Song, Dallas, Tex.

[73] Assignee: Candle Song Inc., Dallas, Tex.

[21] Appl. No.: 09/021,439

[22] Filed: Feb. 10, 1998

[51] Int. Cl.[6] ..... F23D 3/16

[52] U.S. Cl. ..... 431/253; 431/289

[58] Field of Search ..... 431/125, 126, 431/253, 288, 289, 325, 79

[56] References Cited

U.S. PATENT DOCUMENTS

| | | | |
|---|---|---|---|
| 4,477,249 | 10/1984 | Ruzek et al. | 431/253 |
| 4,568,269 | 2/1986 | Lin . | |
| 4,804,323 | 2/1989 | Kim | 431/253 |
| 4,983,119 | 1/1991 | Lin | 431/253 |
| 5,015,175 | 5/1991 | Lee | 431/253 |
| 5,363,590 | 11/1994 | Lee | 431/253 |

*Primary Examiner*—James C. Yeung
*Attorney, Agent, or Firm*—David W. Carstens; Carstens, Yee & Cahoon

[57] ABSTRACT

The candle has a wick that contains an optical guide, such as a fiber optic cable. An electronic circuit is coupled to the optical guide so that when an optical signal is received by the circuit, it plays a musical tune. For example, the optical guide can be coupled to an optical switch, so that the optical signal produced by the flame will close the switch and complete a circuit. The circuit can include a storage device, such as an IC CHIP, to store a musical tune. This tune is then played when the candle is lit. When the flame is extinguished, the burnt wick will prevent ambient light from activating the circuit.

19 Claims, 1 Drawing Sheet

MUSIC PRODUCING CANDLE

TECHNICAL FIELD OF THE INVENTION

The present invention relates to a music producing candle and specifically to a candle that produces a musical tune when the candle's wick is lit.

BACKGROUND OF THE INVENTION

Candles produce both necessary and pleasurable effects. The light can be used to illuminate rooms. As importantly, the quality of the light produces a more tranquil effect than overhead fluorescent bulbs and even incandescent bulbs. The flicker and warm glow of a candle has a soothing effect. To enhance the soothing effect, some prior art candles have incorporated a music storage device which is enabled upon the lighting of the candle.

U.S. Pat. No. 5,015,175 to Lee discloses a birthday candle that has a thermoresponsive member adjacent to the wick. When the candle is lit, the heat from the candle creates a voltage in the thermoresponsive member. The voltage drives a circuit having a memory. The memory can store a birthday tune. Therefore, when the candle is lit, the birthday tune is played. However, the Lee design has been shown to be unreliable. The heat from the flame is not constant, and if a breeze pushes the flame away from the thermoresponsive member, the tune will stop.

U.S. Pat. No. 4,477,249 to Ruzek et al. discloses a candle that includes an optical fiber adjacent to the candle's wick. The optical fiber runs through the body of the candle and is connected to an electrical circuit. When the candle is lit, its light is channeled through the optical fiber and closes an optical switch. When the switch is closed, the circuit is completed and a semiconductor storage device is activated. A musical tune is stored on the storage device. The tune is played on a speaker. The optical fiber is melted away with the burning of the wick.

The Ruzek design suffers from the difficulty that it is easily triggered by ambient light in the room. In other words, if any light is on in the same room as the candle, then the music is played. Likewise, natural sunlight can trigger the candle. Further, the electronics assembly is nested in the base of the candle, increasing the cost of producing the candle. Further, both the wick and the optical fiber must be suspended in the wax during the formation of the candle. If the spacing between the two diverges, the optical fiber may not be properly spaced for connection to the electrical circuit.

A need exists for a candle that can play a musical tune when lit, that is both reliable and cost effective. The candle should incorporate an electronic circuit that can be turned off even when the candle is lit. The volume of the song should be controllable. Further, the tune should stop when the candle is extinguished. In other words, ambient light should not trigger the circuit.

SUMMARY OF THE INVENTION

The present invention overcomes many of the disadvantages of the prior art candles, the most important one being the effect of ambient light. The candle uses an optical guide within the wick. It is well known that a wick blackens upon burning. This is due to the ash from the combustion of the wick. This ash is used to shield the optical guide when the candle is not in use. In other words, when the wick is lit, the flame's light is transmitted through the optical guide to an optical switch. However, when the candle is extinguished, the soot and ash on the remaining wick sufficiently shields the optical guide from ambient light. The optical guide is made of a material that burns away at the same rate as the wick.

The present invention can also be placed onto a base which contains the electronic circuit and memory means. The wick and optical guide in the candle will necessarily extend out the base of the candle to engage the electronic circuit. The base of the candle can be configured to positively register with the base. For example, the candle base can have a off-centered peg portion that engages a similarly shaped port in the base. This forces the user to place the candle onto the base with the correct orientation. A further advantage of this embodiment, is that it allows the more expensive electronics to be placed into a reusable base, while the less expensive optical guide is placed in the disposable candle.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
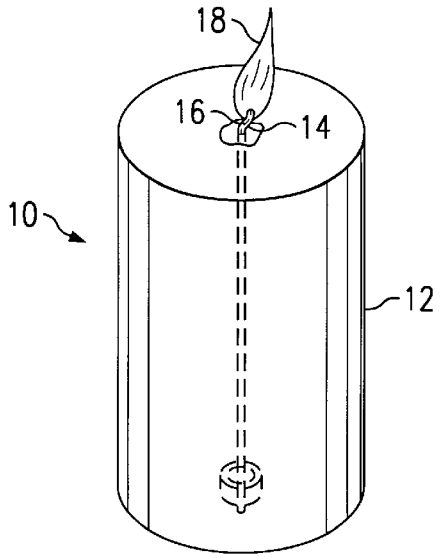
FIG. 1 is a sectional view across a candle embodying the present invention and having an optical guide within its wick.

Referring to FIG. 1, a candle 10 is shown which embodies the present invention. The candle 10 can have a generally cylindrical body 12 as shown or any other desirable shape. As expected, the candle will be made of a combustible material such as wax. The candle can also include coloring and/or a fragrance for use with aroma therapy. A wick 14 can be axially located as shown. An optical guide 16 is located within the wick 14. The optical guide is preferably an optical fiber. In use, the wick is ignited to produce a flame 18. Once the flame is present, the wick and an amount of wax is consumed to produce the flame. However, the flame 18 produces sufficient light for an optical signal is transmitted down the optical fiber 14.

In use, the optical signal is constant because the optical fiber is in the midst of the flame. A sufficient quantity of light is always supplied to the optical fiber. As the wick and wax are consumed, the optical fiber can also be consumed. In other words, the wick and optical fiber will stay approximately the same height relative to the top surface of the candle.

Figure 2:
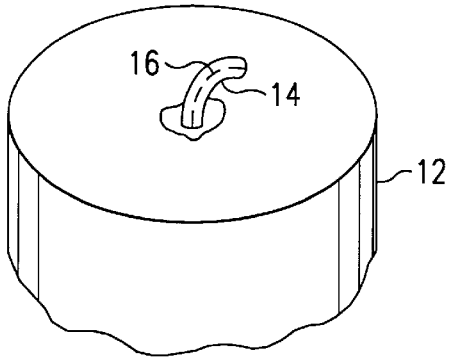
FIG. 2 is a detailed view of the wick showing the effect of the products of combustion on the optical guide.

FIG. 2 illustrates a more detailed view of the wick 14 and optical guide 16. A deficiency with prior art candle designs is the impact of ambient light 2. The ambient light 2 should not trigger the playing of a musical tone when the candle is not lit. The exposed optical guide of Ruzek '249, discussed above, suffers from this flaw. By nesting the optical guide 16 into the wick 14, the effect of ambient light is greatly diminished. When the flame is extinguished, the wick has been burnt and blackened. This blackened wick prevents the ambient light from reaching the optical guide.

Figure 3:
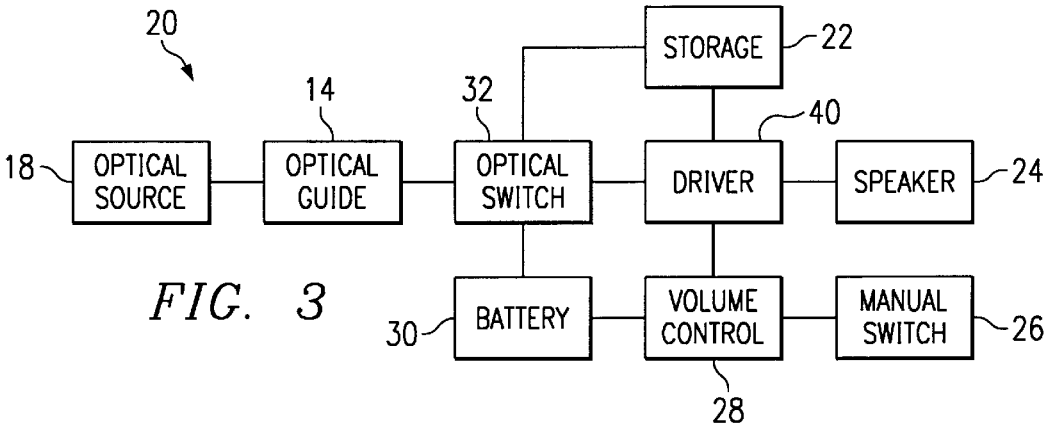
FIG. 3 is a block diagram of the electrical circuit used to implement the invention.

An electrical circuit 20, such as shown in FIG. 3, is used to generate the musical tune played. The optical source 18 is the flame. The optical guide 14 is the optical fiber nested in the wick. The optical signal carried down the optical guide is used to activate an optical switch. In other words, when the optical signal is sensed, then the switch is closed, completing the circuit 20. Once the circuit is closed, a storage device 22 can produce an output to a speaker 24 through a driver 40. The storage device is preferably an IC CHIP. The output is preferably a musical tune. However, it could also be spoken words, such as a poetry reading, a series of tones, or any other storable sound. A manual switch 26 can also be used to disable the circuit when only a candle burning is desired. A volume control 28 can be added to the circuit to allow the user the ability to adjust the loudness of the music. Finally, a voltage source 30 is also included to power the circuit. The voltage source could be batteries or even an AC power source.

Figure 4:
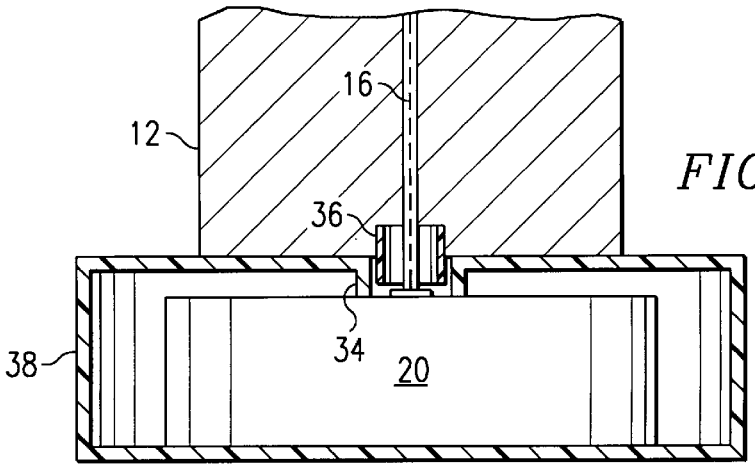
FIG. 4 is a sectional view across the candle and base of an alternate embodiment.

The circuit 20 can be located in various locations. In one embodiment, the circuit 20 is located in the base of the candle. In another embodiment, the circuit 20 could be attached to the outside of the candle. In another embodiment, the circuit 20 could be located in a candle base 38, as shown in FIG. 4. In this embodiment, any number of replacement candles can be used with the same base. The replacement candles could be less expensive because they would not need to include the electronic circuit 20. The optical guide must be properly aligned with the optical switch in the base 38. Therefore, the candle 12 must be positively registered with the base 38. This can be accomplished with the use of tabs 36 located on the base of the candle 12 which align with notch 34 on the base. Any number of alignment methods can be used.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

I claim:

1. A candle for use in producing music comprising:

(a) a candle with two end surfaces having a wick substantially contained therein with the wick having a first and second end, each end extending beyond said surfaces;

(b) an optical guide located coaxially within the wick.

2. The candle of claim 1 further comprising:

(c) means for producing music coupled to said optical guide.

3. The candle of claim 2 wherein said means for producing music comprises an optical switch coupled to said optical guide.

4. The candle of claim 3 wherein said means for producing music further comprises a volume control.

5. The candle of claim 3 wherein said means for producing music further comprises a manual switch.

6. The candle of claim 3 wherein said means for producing music further comprises a voltage source.

7. The candle of claim 2 further comprises:

(d) a base upon which the candle can be placed.

8. The candle of claim 7 wherein said base contains said means for producing music.

9. The candle of claim 7 wherein said base and candle comprise registration means.

10. The candle of claim 1 wherein said optical guide comprises a optical fiber.

11. The candle of claim 10 wherein said optical fiber is meltable.

12. A music producing candle comprising:

(a) a candle with two end surfaces having a wick substantially contained therein with the wick having a first and second end, each end extending beyond said surfaces;

(b) an optical guide located coaxially within said wick; and (c) a memory coupled to a speaker; wherein said memory contains a musical recording and is activated upon a signal received through said optical guide.

13. The music producing candle of claim 12 wherein said optical guide is an optical fiber.

14. The music producing candle of claim 12 wherein said wick and said optical fiber are consumable.

15. The music producing candle of claim 13 wherein said wick and optical fiber are consumable at substantially the same rate.

16. The music producing candle of claim 12 wherein said memory is further coupled to a manual switch.

17. The music producing candle of claim 12 further comprises a volume control.

18. The music producing candle of claim 12 further comprises an optical switch coupled to said optical guide.

19. The music producing candle of claim 12 wherein said memory device comprises an IC CHIP.

* * * * *